United States Patent [19]

Aagaard

[11] Patent Number: 4,624,318

[45] Date of Patent: Nov. 25, 1986

[54] METHOD AND MEANS FOR STORING A MARINE RISER

[75] Inventor: Paul M. Aagaard, Fullerton, Calif.

[73] Assignee: Chevron Research Company, San Francisco, Calif.

[21] Appl. No.: 691,998

[22] Filed: Mar. 11, 1985

Related U.S. Application Data

[63] Continuation-in-part of Ser. No. 498,230, May 26, 1983, abandoned.

[51] Int. Cl.[4] ..... E21B 7/124; E21B 33/043

[52] U.S. Cl. ..... 166/359; 166/364; 175/5; 405/195; 405/211

[58] Field of Search ..... 405/169, 195, 211, 216, 405/217, 226; 175/5, 7; 166/113, 338, 339, 350, 359, 362, 364, 365, 367

[56] References Cited

U.S. PATENT DOCUMENTS

| | | | |
|---|---|---|---|
| 3,265,130 | 8/1966 | Watkins | 405/195 X |
| 3,301,322 | 1/1967 | Newsome | 166/339 |
| 3,664,437 | 5/1972 | McCulloch | 175/5 |
| 3,744,561 | 7/1973 | Shatto | 166/359 X |
| 4,126,183 | 11/1978 | Walker | 166/364 X |
| 4,147,221 | 4/1979 | Ilfrey et al. | 166/367 X |
| 4,189,255 | 2/1980 | Macan et al. | 405/195 X |
| 4,193,455 | 3/1980 | Steddum et al. | 405/211 X |
| 4,194,568 | 3/1980 | Burési | 166/367 X |
| 4,214,842 | 7/1980 | Franks | 405/195 X |
| 4,234,047 | 11/1980 | Mott | 175/5 |
| 4,403,658 | 9/1983 | Watkins | 166/367 X |

*Primary Examiner*—Cornelius J. Husar
*Assistant Examiner*—Nancy J. Stodola
*Attorney, Agent, or Firm*—S. R. LaPaglia; E. J. Keeling; P. L. McGarrigle

[57] ABSTRACT

A method and means for storing a marine riser is disclosed for relocating an offshore mobile unit from a drilling or production site. The riser is disconnected from a subsea port and lowered into an auxiliary borehole. Means are provided for the lowering and raising of the marine riser and positioning of same.

13 Claims, 2 Drawing Figures

METHOD AND MEANS FOR STORING A MARINE RISER

CROSS-REFERENCE TO RELATED APPLICATION

This case is a continuation in part of U.S. patent application Ser. No. 498,230 filed May 16, 1983, now abandoned.

INTRODUCTION

The present invention relates to drilling and producing operations from an offshore mobile unit. Rapid installation and removal of an offshore mobile unit and marine riser promotes efficient exploration and production operations as well as affords protection from encroaching objects, such as ice masses, and severe storms. Removal of an offshore mobile unit and marine riser is occasionally necessary to avoid these hazards. As a result, the present invention relates to a method and means for storing and protecting a marine riser. The disclosed method and means minimizes expense, time and effort, and further promotes safety in protecting and storing a marine riser. The most probable sea areas where this invention would be employed would be those which require that the offshore operation be subject to a minimum amount of downtime or where it is essential that the riser be secured rapidly.

BACKGROUND OF THE INVENTION

The use of offshore mobile units for drilling and producing operations has become relatively common place in recent years. As the supply of oil becomes more scarce, exploration and production activities are being pushed into more environmentally hostile areas. For example, in colder regions, ice masses, driven by wind and currents, pose particular problems. Although the smaller ice masses can be diverted by various methods, the larger ones cannot be so handled and the threat of collision requires the operation to be shut down and the vessel relocated as quickly as possible to void injury to personnel and property. Therefore, it is occasionally necessary to remove the offshore mobile unit and marine riser to avoid damage resulting from ice or severe storms. However, the installation and removal of an offshore unit and marine riser is a costly and time-consuming operation. A reduction in expense, time or effort provides more efficient exploration and production.

In drilling wells and producing oil at an offshore location, it is necessary that an elongated conduit, or marine riser, extend from a vessel through the water column to a primary borehole or wellhead. The riser encloses the drill string and permits fluid circulation during drilling operations. Risers are also used, after completion of the well, to transport hydrocarbons to the surface. Normally the risers are comprised of a series of 30 to 40 foot sections which are sealably joined to provide a single elongated conduit. These sections are stored horizontally on the deck of the ship and, when needed, are raised to a vertical position to be threaded onto the section below. A drill string is stored and assembled in the same fashion, but is assembled and lowered independently of the riser once it is in place. The riser is, ideally, assembled and disassembled once, while the drill string is assembled and disassembled many times (to change drill bits, insert tools, etc.).

Technology used heretofore employs either mechanical or remote methods (such as guideline, acoustic and/or television systems) to aid in the alignment of a marine riser and subsea wellhead when the riser is connected to the wellhead. For an example of wellhead connection equipment see Watkins, U.S. Pat. No. 3,265,130; Franks, U.S. Pat. No. 4,214,842; and British Patent Specification No. 1,341,047. If the vessel must be relocated from the drilling or producing site, the drill string and marine riser will normally be withdrawn sequentially by sections and stored on the vessel. The desirability of minimizing such a time-consuming and laborious operation is recognized in the art. For instance in U.S. Pat. No. 4,234,047, issued Nov. 18, 1980 to Geroge E. Mott, the use of a riser in two detachably connectable segments is advocated. If the vessel must be moved, the riser is disconnected at an intermediate point several hundred feet below the water surface. The upper riser segment is then withdrawn and the lower riser segment is left in place. Such a system is only practical, however, in waters of sufficient depth so that the lower remaining segment is not endangered. Another example of an attempt to minimize this riser withdrawal time is a riser set aside system as shown by Ilfrey et al., U.S. Pat. No. 4,147,221, in which the riser is not removed from the water column, but set aside onto an adjacent support. This system, however, still leaves the riser vulnerable to environmental hazards even more so than that described by Mott. Other riser systems are generally shown by: Watkins, U.S. Pat. No. 4,403,658; Buresi et al., U.S. Pat. No. 4,194,568; Walker, U.S. Pat. No. 4,126,183; and McCulloch, U.S. Pat. No. 3,664,437.

The present invention provides a method and means for storing and protecting a marine riser in seas where conditions may require moving the drilling vessel off its location and which may advantageously be used in both shallow and deep waters.

SUMMARY OF THE INVENTION

The present invention concerns a system for use in offshore drilling where conditions may require rapid securing of a marine riser in order to move a drilling vessel off location. The vessel and riser would be moved to prevent damage to the riser due to iceberg incursions or excessive horizontal or vertical motion during sea storms. It includes a marine riser that extends from the vessel to a primary borehole in the seafloor, wellhead means to couple the riser to the primary borehole, a proximately located auxiliary borehole that is as deep as the marine riser, means for raising and lowering the riser, and means to guide the lower end of the riser to either the primary of auxiliary boreholes.

A vessel, located at a drilling site, first sets a subbase onto the seafloor, then drills a primary borehole to accommodate a surface conductor. A main base and the surface conductor are then installed and cemented into place and the wellhead is attached. Next, an auxiliary borehole is drilled substantially as deep as the length of a riser that extends from the vessel to the seafloor. Once this has been completed the riser is installed onto the primary borehole and the drilling operation can then proceed. When an environmental condition requires that the riser be moved out of the way, it is disconnected from the wellhead at the primary borehole, guided to the adjacent auxiliary borehole and then lowered into the auxiliary hole. Once the environmental condition has passed, the riser may be retrieved, guided back to the primary borehole and reconnected to the wellhead at the primary borehole to resume operations.

PRINCIPAL OBJECT OF THE INVENTION

An object of the present invention is to provide method and means for protecting and storing a marine riser during relocation of an offshore mobile unit from its operating site. The rapid storage of the marine riser promotes efficient exploration and production operations, safety, and also provides precaution from potential collisions.

Additional objects and advantages of the present invention will become apparent from a detailed reading from the specifications and drawings which are incorporated herein and made a part of this invention.

DESCRIPTION OF THE PREFERRED EMBODIMENT

Figure 1:
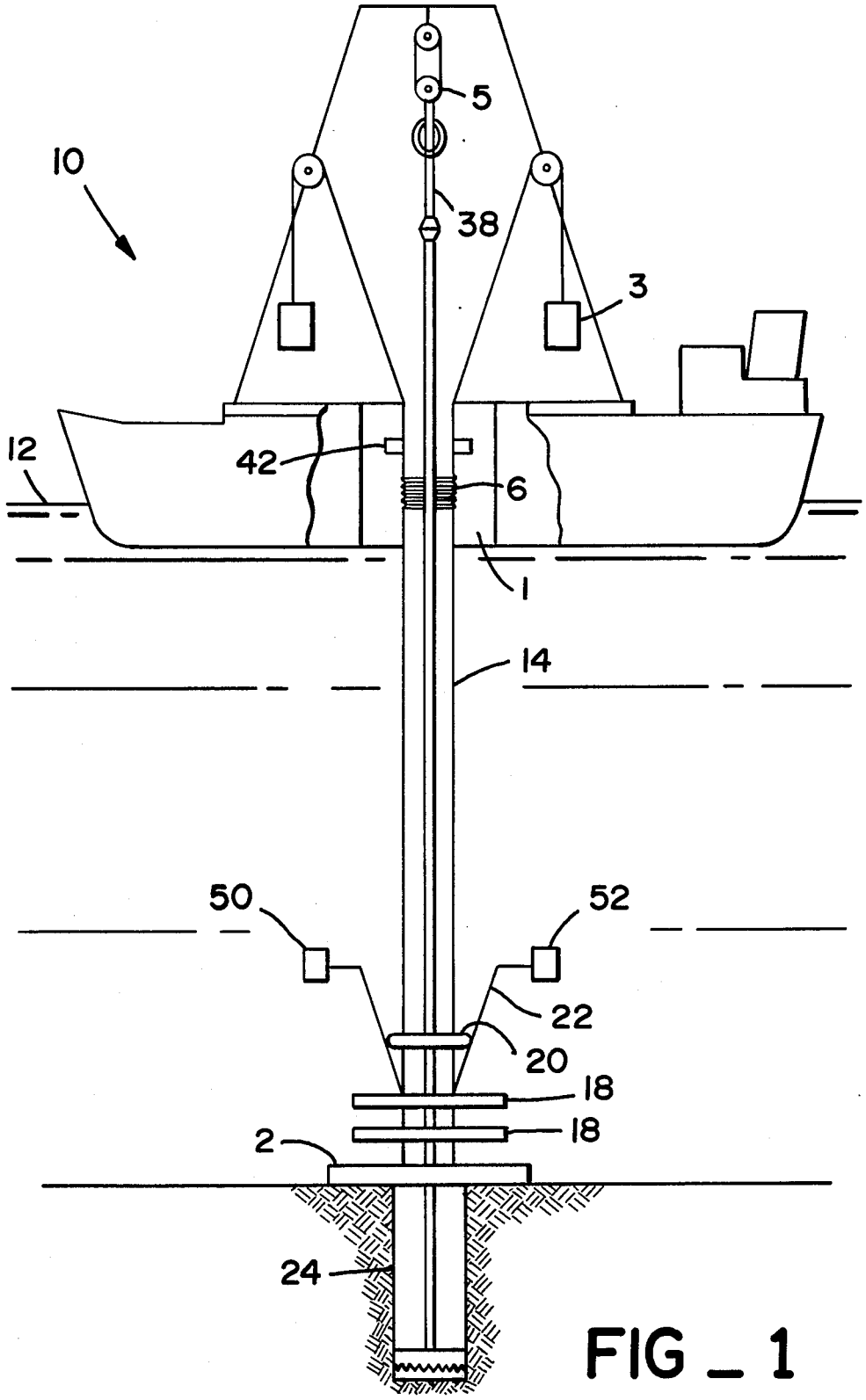
FIG. 1 is a schematic view of a marine riser during drilling operations.

Referring to the drawings, and in particular to FIG. 1, there is shown a drilling vessel 10, floating on a water surface 12. Although the present description is directed to a drill ship 10, it is understood that the invention is equally applicable to other drilling, producing, or loading facilities having movable surface structures. A marine riser 14 housing a drill string 38 extends through a moonpool 1 to a wellhead 2 for a primary borehole 24. The primary borehole 24, and wellhead 2 may include a pipeline discharge unit (not shown), production distribution unit or any such instrument for introducing or discharging fluid (not shown).

A riser tensioner 3 places the riser 14 in tension to reduce buckling or bending tendencies in the riser 14 due to lateral forces. Draw works 5 is disconnectably connected to riser running tool 4 which holds, raises, and lowers the riser 14 with the respect to the primary borehole (it is taken off and put on with each new riser segment) and a telescopic joint 6 may be provided at the upper end (or along the length) of the riser 14 to compensate for vertical movement of the vessel 10 due to wave or tidal action. A flange 42 is provided on the upper end of the riser 14 to support the riser 14 when inserted into an auxiliary borehole.

The riser 14 is connected at its lowermost end to the wellhead 2, through a blowout preventer stack 18 by means of remotely operable coupling joint 20. The coupling joint 20 is preferably hydaulically operated from the vessel 10 to connect or disconnect the riser 14 with respect to the blowout preventer stack 18, but it may be operated by other means. Funnel 22 and remotely actuated primary borehole transponders 50 and 52 are installed over the blowout preventer stack 18 to assist in the proper positioning of the riser 14 over the blowout preventer stack 18 as hereinafter discussed.

Figure 2:
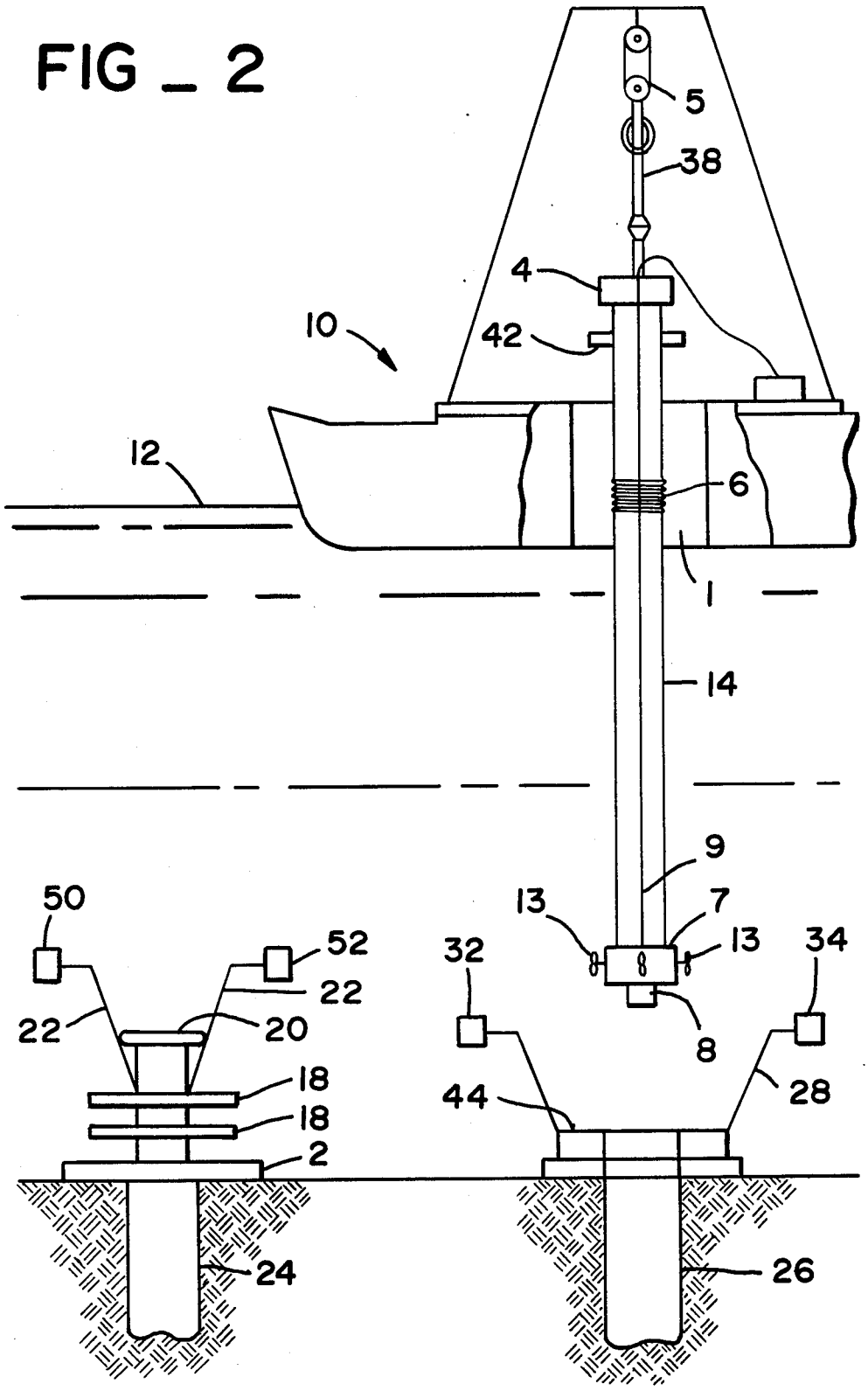
FIG. 2 is a schematic view of the riser after it has been disconnected from the primary borehole and is about to be lowered in an auxiliary borehole.

Referrring to FIG. 2, an auxiliary borehole 26 is shown which is proximately located to the primary borehole 24 (the auxiliary borehole 26 may be cased to improve its structural integrity). The auxiliary borehole 26 may be drilled at any point in time, but it must be available when needed. A probable drilling sequence would be to first set a subbase of some sort on the seafloor for the primary borehole 24 (in this case including a funnel 22). Then drill for a 30 inch conductor which could be as deep as 100 to 200 feet (but most likely 90 to 100 feet). The 30 inch conductor would then be lowered and cemented in place with the subbase. This provides pressure integrity in the upper part of the borehole 24 (especially after the blowout preventer stack (BOP) has been latched into place). Once the 30 inch conductor has been set in place then the auxiliary borehole 26 could be drilled. After it is drilled to an appropriate depth, which, to serve its purpose, should substantially cover the entire length of the riser (the auxiliary borehole 26 may need to be deep enough to set the riser below the seafloor in iceberg scour areas) the BOP may be latched into place on the primary borehole 24, the rise attached to it, then the remainder of the well may be drilled.

A guidance system for locating the position of marine riser 14 relative to the primary borehole 24 (and wellhead 2) or auxiliary borehole 26 is also provided. Although the current invention is directed to an acoustical guidance system, it is understood that the invention is equally applicable to variations thereof and other guidance systems; including closed-circuit television camera, guideline guidance systems or even a track or template to guide the riser from one borehole to the other. The auxiliary borehole 26 also has funnel 28 to assist in the insertion of the riser 14 into the auxiliary borehole 26. Remotely actuated auxiliary borehole transponders 32 and 34 are affixed to the auxiliary borehole 26 in the proximity of funnel 28. The transponders 32 and 34 may be triggered in response to a command signal emanating from the vessel 10. A monitored receiver (not shown), mounted on board the vessel 10, may then be used to "home" in on the transponder signals through the control head 7, disconnectably connected to the lowermost end of the marine riser 14. Control head 7 includes an acoustic transmitter/receiver 8 and mechanical or hydraulic jet thrusters 13 for positioning the lowermost end of the marine riser 14 over the auxiliary borehole 26. A cable 9 lowers and raises a control head 7 relative to the marine riser 14 and also transmits signals from the vessel 10 to the control head 7. A riser hanger 44 is also provided so that the riser flange 42 will have a support when it hangs in the auxiliary borehole 26.

In the event it becomes necessary to relocate the drilling vessel 10 and store the marine riser 14, the following action should be taken. Initially, the drill string 38 is withdrawn from the primary borehole 24 through the riser 14 and stored in segments aboard the vessel 10. The drill string 38 is then extended between draw works 5 and the remotely operable riser running tool 4 which is disconnectably connected to the uppermost end of the marine riser 14. Coupling joint 20 is then hydraulicly actuated to disconnect the riser 14 from the wellhead 2, the blowout preventer 18, and any other wellhead equipment. The draw works 5 then raises the marine riser 14 above the wellbore 24 using the drill string 38. (The drill string 38 may be used to raise and lower the riser 14, but a cable system could be devised to do this task. A cable may have corrosion problems, but may also perform the job quicker.) Control head 7 is lowered down the marine riser 14 by the cable 9 to its lowermost end and connected thereto. It may be lowered through the riser 14 (eventhough it appears larger in the figure than the riser 14) or along the outside of the riser. If the control head 7 is lowered on the outside of the riser 14 then a track of some sort should be provided. Utilizing the control head 7 and transponders 32 and 34, the lowermost end of the marine riser 14 is positioned over the auxiliary borehole 26. The drill string 38 is extended to controllably lower the riser 14 into the auxiliary borehole 26. The control head 7 and cable 9 connected therewith are retracted when the lowermost end of the marine riser 14 passes below the rim of funnel 28. After the riser 14 is fully lowered into the bore 26, riser running tool 4 is remotely detached, the drill string 38 is withdrawn and the vessel 10 may be moved. To properly hang the riser 14 in the auxiliary borehole 26 the upper end of the riser 14 is provided with a flange 42 or other similar device to engage a riser hanger 44 at the auxiliary borehole mouth.

To restore operation at the original site the vessel 10 is first positioned above the auxiliary borehole 26. Then the riser running tool 4 and the control head 7 are disconnectably connected to the lowermost end of the drill string 38 and the drill string 38 is lowered to a position immediately below the rim of the funnel 28. The control head 7 is then released from the drill string 38 and the riser running tool 4 is connected with the uppermost end of the marine riser 14. The control head 7 is returned to the drilling vessel 10 by the cable 9 and the marine riser 14 is raised from the auxiliary borehole 26. Once the riser 14 is fully retracted from the auxiliary borehole 26 the control head 7 is lowered down the riser 14 and disconnectably connected to its lowermost end. The lowermost end of the riser 14 is guided to a position directly above the wellhead 2 and the primary borehole 24 where it is then lowered to a position immediately below the rim of funnel 22. The control head 7 is then disconnected and raised to the surface vessel 10 and the marine riser 14 is connected to the wellhead 2 by means of the remotely operable coupling joint 20. The riser 4 running tool 4 is then removed from the uppermost end of the marine riser 14 and operations are once again commenced.

While a certain preferred embodiment has specifically disclosed, it should be understood that the invention is not limited thereto, as many variations will be readily apparent to those skilled in the art and the invention is to be given its broadest possible interpretation within the terms of the following claims.

What is claimed is:

1. A system for use in offshore drilling in seas where conditions may require moving the drilling vessel from location and which includes a marine riser extending from a primary borehole to the drilling vessel comprising;

a primary borehole being drilled to an extended depth into the seafloor;

wellhead means positioned above said primary borehole and in operable relationship therewith, said wellhead means including coupling means for detachably connecting a marine riser thereto;

a marine riser extending from a surface vessel to the primary borehole and disconnectably attached to said coupling means;

an auxiliary borehole having a depth substantially as deep as the length of said marine riser, said auxiliary borehole located closely adjacent to said primary borehole for receiving said marine riser when said marine riser is detached from said coupling means and is positioned above said auxiliary borehole;

draw works means on said drilling vessel, said draw works means for use in raising and lowering said marine riser and including a riser running tool disconnectably connectable to the upper end of said marine riser, and control means on the lower end of said marine riser operable in cooperation with said draw works means to position the lower end of said marine riser respectively over said auxiliary borehole and to lower said marine riser into said auxiliary borehole when it is desired to store said marine riser in said auxiliary borehole and to remove said marine riser from said auxiliary borehole and to position the lower end of said marine riser over said wellhead means for connection with said coupling means when it is desired to reconnect said marine riser to said primary borehole.

2. The system of claim 1, where the control means to position the lower end of the marine riser includes:

remotely operable thrusters fixed to the lowermost end of the riser; and guidance means for detecting the position of the lowermost end of the riser with respect to the auxiliary borehole and the primary borehole.

3. The system of claim 2 where the guidance means further include a close-circuit television means for visually detecting and locating the auxiliary borehole so that the riser may be directed to the uppermost end of said auxiliary borehole.

4. The system of claim 2 where the guidance means further include an acoustic positioning system for detecting and locating the auxiliary borehole so that the riser may be directed to the uppermost end of said auxiliary borehole.

5. The system of claim 2 where the guidance means further include a guide line positioning system for detecting and locating the auxiliary borehole so that the riser may be directed to the uppermost end of the borehole.

6. The system of claim 1, further including a flange on the upper end of the riser and a riser hanger on the upper edge of the auxiliary borehole so that the riser may be hung from the flange on the hanger in the auxiliary borehole.

7. The system of claim 1, further including a funnel on both the primary and the auxiliary boreholes to assist in directing the marine riser to the uppermost end of either the primary or the auxiliary borehole.

8. The system of claim 1, wherein the draw works means includes a drill string.

9. The system of claim 1 where the auxiliary borehole is cased.

10. A method for rapidly storing and protecting a marine riser that extends from a vessel to the seafloor during offshore oil drilling and producing operations in seas where conditions may require moving the vessel off location, comprising:

drilling an auxiliary borehole in the seafloor substantially as deep as the length of a marine riser for use in drilling a primary borehole, the auxiliary borehole being located closely adjacent to the location of the proposed primary borehole for receiving the marine riser when the riser is lowered into the auxiliary borehole;

extending a marine riser from a drilling vessel to the seafloor;

inserting a drill string through said marine riser;

drilling a primary borehole in the seafloor;

disconnectably connecting said riser to the primary borehole with a connection means for normal oil well drilling operations;

disconnecting the marine riser from the primary borehole as a single unitary body when the riser is threatened by sea conditions;

moving the marine riser and positioning the lower most end thereof over the auxiliary borehole; and controllably lowering the riser into the auxiliary borehole until the riser is substantially protected therein.

11. A method for rapidly storing and protecting a marine riser that extends from a vessel to the seafloor during oil drilling and producing operations in seas that periodically require the vessel to move off location, comprising:

drilling an auxiliary borehole in the seafloor substantially as deep as the length of a marine riser for use in drilling a primary borehole, the auxiliary borehole being located closely adjacent to the location of the proposed primary borehole for receiving the marine riser when the riser is lowered into the auxiliary borehole;

extending a marine riser, having a drill string, from a drilling vessel to the seafloor;

inserting a drill string through said marine riser;

drilling a primary borehole in the seafloor;

disconnectably connecting the riser to the primary borehole with a connection means for normal oil well drilling and producing operations;

withdrawing a drill string that extends down the marine riser and into the primary borehole from the primary borehole when sea conditions become hazardous;

connecting the drill string to the upper end of the marine riser to raise and lower the marine riser;

disconnecting the marine riser from the primary borehole as a single unitary body when the riser is threatened by sea conditions;

raising the riser off of the wellhead;

attaching a control head having a guidance and positioning means to the lowermost end of the riser;

positioning the lowermost end of the riser over the auxiliary borehole by using the control head;

controllably lowering the drill string to likewise controllably lower the riser into the auxiliary borehole until the riser is substantially protected therein;

resting the upper end of the riser on a support in the upper end of the auxiliary borehole; and disconnecting the drill string from the upper end of the riser so that the riser may be protected by virtue of its being underneath the seafloor and the drill string may afterwards be removed and stored on the vessel.

12. A method for rapidly storing and protecting a marine riser that extends from a vessel to the seafloor during oil drilling and producing operations in seas that periodically require the vessel to move off location, comprising:

lowering a subbase from a drilling vessel to the seafloor;

extending a drill string from a drilling vessel to the subbase on the sea floor;

partially drilling a primary borehole in the seafloor;

casing the partially drilled primary borehole;

drilling an auxiliary borehole in the seafloor substantially as long as the length of a marine riser needed to extend from the drilling vessel to the seafloor, the auxiliary borehole being located closely adjacent to the primary borehole for receiving the marine riser when the riser is positioned above the auxiliary borehole and lowered into the auxiliary borehole;

connecting a marine riser having a drill string to the primary borehole to complete the drilling of the primary borehole;

withdrawing the drill string that extends down the marine riser and into the primary borehole from the primary borehole when sea conditions become hazardous;

connecting the drill string to the upper end of the marine riser to raise and lower the marine riser;

disconnecting the marine riser from the primary borehole as a single unitary body when the riser is threatened by sea conditions;

raising the riser off of the wellhead;

attaching a control head having a guidance and positioning means to the lowermost end of the riser;

positioning the lowermost end of the riser over the auxiliary borehole by using the control head;

controllably lowering the drill string to likewise controllably lower the riser into the auxiliary borehole until the riser is substantially protected therein;

resting the upper end of the riser on a support in the upper end of the auxiliary borehole; and disconnecting the drill string from the upper end of the riser so that the riser may be protected by virtue of its being underneath the seafloor and the drill string may afterwards be removed and stored on the vessel.

13. A method for connecting a marine riser to a primary borehole when the riser is being stored in an auxiliary borehole, comprising:

extending a means for raising a riser from a vessel to the auxiliary borehole;

remotely connecting the means for raising the riser to the uppermost end of the riser;

raising the riser as a unitary body from the auxiliary borehole with the raising means so that the entire riser is out of the auxiliary borehole;

moving the lowermost end of the riser to a position over the primary borehole;

remotely connecting the riser to the primary borehole; and disconnecting the raising means from the uppermost end of the riser so that there may be a continuous tubular connection between the vessel and the primary borehole and normal drilling and producing operations may be resumed.

* * * * *